US010250002B2

(12) United States Patent
Ishikawa et al.

(10) Patent No.: US 10,250,002 B2
(45) Date of Patent: Apr. 2, 2019

(54) METHOD OF MANUFACTURING ELECTRICAL CONNECTION BLOCK

(71) Applicant: YAZAKI CORPORATION, Tokyo (JP)

(72) Inventors: Yoshinori Ishikawa, Shizuoka (JP); Naoto Taguchi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 706 days.

(21) Appl. No.: 14/935,572

(22) Filed: Nov. 9, 2015

(65) Prior Publication Data

US 2016/0064887 A1 Mar. 3, 2016

Related U.S. Application Data

(63) Continuation of application No. PCT/JP2014/062670, filed on May 13, 2014.

(30) Foreign Application Priority Data

May 13, 2013 (JP) ..... 2013-101599

(51) Int. Cl.
*H01R 43/16* (2006.01)
*H01R 43/24* (2006.01)
(Continued)

(52) U.S. Cl.
CPC ..... *H01R 43/16* (2013.01); *H01H 85/044* (2013.01); *H01R 43/24* (2013.01);
(Continued)

(58) Field of Classification Search
CPC ..... H01R 43/16; H01R 43/24; H01R 11/287; H01R 13/684; H01H 85/044; H01H 2085/025; H01H 2085/0555
(Continued)

(56) References Cited

U.S. PATENT DOCUMENTS

2001/0011939 A1* 8/2001 Inaba ..... H01H 85/044 337/265
2003/0022536 A1 1/2003 Saito et al.
(Continued)

FOREIGN PATENT DOCUMENTS

| | | | |
|---|---|---|---|
| CN | 102754178 | A | 10/2012 |
| DE | 10 2008 052 444 | A1 | 6/2009 |
| JP | 10-50199 | A | 2/1998 |
| JP | 2012-3904 | A | 1/2012 |
| JP | 2012-33318 | A | 2/2012 |

OTHER PUBLICATIONS

English translation of the Written Opinion of the International Search Report for PCT/JP2014/062670 dated Jul. 29, 2014.
(Continued)

*Primary Examiner* — Austin Murata
(74) *Attorney, Agent, or Firm* — Kenealy Vaidya LLP

(57) ABSTRACT

An electric connection block is provided with a bus bar formed from a press-formed product of a metal plate member and a resin-made housing insert molded integrally with the bus bar. The bus bar is provided with a flat plate-shaped main plate part and a standing terminal erected by bending a base end connected to a portion of the main plate part relative to the main plate part. The electric connection block is manufactured by insert molding the housing integrally with the bus bar in a before-bending state where the standing terminal is located on the same plane as the main plate part, and bending the base end of the standing terminal to thereby erect the standing terminal relative to the main plate part after the insert molding of the housing.

8 Claims, 6 Drawing Sheets

(51) Int. Cl.

| | |
|---|---|
| ***H01H 85/044*** | (2006.01) |
| *H01R 11/28* | (2006.01) |
| *H01R 13/684* | (2011.01) |
| *H01H 85/02* | (2006.01) |
| *H01H 85/055* | (2006.01) |

(52) U.S. Cl.
CPC ..... *H01H 2085/025* (2013.01); *H01H 2085/0555* (2013.01); *H01R 11/287* (2013.01); *H01R 13/684* (2013.01)

(58) Field of Classification Search
USPC ..... 439/630
See application file for complete search history.

(56) References Cited

U.S. PATENT DOCUMENTS

| | | | | |
|---|---|---|---|---|
| 2004/0137792 | A1* | 7/2004 | Matsumura ..... | H01H 85/044 439/630 |
| 2012/0302098 | A1 | 11/2012 | Matsumoto et al. | |
| 2013/0181806 | A1 | 7/2013 | Onoda et al. | |

OTHER PUBLICATIONS

Chinese Office Action for the related Chinese Patent Application No. 201480027108.8 dated Dec. 2, 2016.
International Search Report and Written Opinion of the International Search Report for PCT/JP2014/062670 dated Jul. 29, 2014.

* cited by examiner

METHOD OF MANUFACTURING ELECTRICAL CONNECTION BLOCK

CROSS REFERENCE TO RELATED APPLICATIONS

This application is a continuation of PCT application No. PCT/JP2014/062670, which was filed on May 13, 2014 based on Japanese Patent Application (No. 2013-101599) filed on May 13, 2013, the contents of which are incorporated herein by reference.

TECHNICAL FIELD

The invention relates to an electric connection block manufacturing method, for example, a manufacturing method for an electric connection block such as a battery direct-attachment fuse terminal (which is hereinafter called "BFT") to be attached to the battery of a vehicle.

BACKGROUND ART

Generally, a BFT is constituted of a bus bar formed by press working a metal flat plate and a resin-made housing so insert molded as to cover other portions of the bus bar than the exposed portion thereof. The bus bar includes integrally therewith an input side terminal part connectable with the positive pole of a battery, an output side terminal part connectable by a load side wire, a welding part for connecting together the input and output side terminal parts, and a tuning fork terminal (standing terminal) connectable by an external part such as an external fuse (see the patent document 1).

FIGS. 8 and 9 explain an example of a conventional BFT: FIG. 8 is a perspective view of a bus bar constituting the BFT; and, FIG. 9 is a perspective view of the BFT. This type of BFT is generally manufactured in the following order.

Firstly, a metal flat plate is press molded to form a bus bar 210 shown in FIG. 8. The bus bar 210 includes: an input side terminal part 211 and output side terminal parts 212, 213, respectively constituting the main plate part; welding parts 218, 219 for connecting together the input and output side terminal parts 211 and 212, 213; an external connection terminal 225; and, tuning fork terminals 221, 222 serving as standing terminals. The tuning fork terminals 221, 222 are used to connect external fuses. Here, the external connection terminal 225 is connected to the output side terminal parts 212, 213 by bridge portions 227, 228 to be cut later in cut expected portions shown by reference sign K. Also, one tuning fork 221 is connected to the input side terminal part 211 by a base part 223 formed continuously with the base end of the tuning fork terminal 221, whereas the other tuning fork terminal 222 is connected to the external connection terminal 225 by a base part 224 formed continuously with the base end of the tuning fork terminal 222.

Next, the base ends of the tuning fork terminals 221, 222 are bent 90° to erect the terminals 221, 222 to be orthogonal to the input side terminal 211 and output side terminals 212, 213 serving as the main plate part. Then, low meting metal, namely, tin chips 216, 217 are caulked and welded to the caulking pieces 214, 215 of the welding parts 218, 219 to complete the welding parts 218, 219. Next, the bus bar 210 is set in a molding mold and, as shown in FIG. 9, a resin-made housing 250 is insert molded. After insert molding, the bridge portions 227, 228 shown in FIG. 8 are cut in the cutting portions K, thereby producing a BFT 201 in which the bus bar 210 and housing 250 are integrated with each other.

In this BFT 201, the input and output side terminal parts 211 and 212, 213 are exposed from the housing 250, thereby enabling connection thereof to a battery terminal or a load side wire. Also, the tuning fork terminals 221, 222 are exposed into an external part mounting part 258 surrounded by a protection wall, the welding part 218, 219 are exposed into window portions 256, 257, and the external connection terminal 225 is exposed into a connector part 259.

PRIOR ART DOCUMENT

Patent Document

[Patent Document 1] JPA Publication No. 2012-3904

SUMMARY OF THE INVENTION

Problems that the Invention is to Solve

Here, since the tuning fork terminals 221, 222 formed in the bus bar 210 require dimension precision, when the bus bar 210 is transferred between manufacturing steps, or when the tin chips are welded, or when the housing 250 is formed, an external force can be applied to the standing terminals 221, 222 unexpectedly, thereby raising a fear that they can be deformed to impair the dimension precision.

The invention is made in view of the above circumstances and thus its object is to provide an electric connection block manufacturing method which can prevent standing terminals such as tuning fork terminals requiring dimension precision from being deformed during production.

Means for Solving the Problems

To achieve the object described above, the manufacturing method for the electric connection block of the present invention is characterized in the following (1) to (6).

(1) The manufacturing method for the electric connection block, the electric connection block including a bus bar formed from a press-formed product of a metal plate member and a resin-made housing insert molded integrally with the bus bar, and the bus bar including the flat plate-shaped main plate parts and standing terminals erected by bending base ends connected to a portion of the main plate parts relative to the main plate parts, the manufacturing method comprising:

insert molding the housing integrally with the bus bar in a before-bending state where the standing terminals are located on the same plane as the main plate parts; and bending the base ends of the standing terminals to thereby erect the standing terminals relative to the main plate parts after insert molding of the housing.

(2) The manufacturing method for the electric connection block according to (1), the manufacturing method comprising:

molding the housing such that the before-bent standing terminals face into openings formed in the housing when insert molding of the housing; and inserting the bending tool into the opening and bending the base ends of the standing terminals to thereby erect the standing terminals after molding of the housing.

(3) The manufacturing method for the electric connection block according to (2), the manufacturing method comprising:

erecting protection walls for protecting the standing terminals on periphery of the opening of the housing.

(4) The manufacturing method for the electric connection block according to (2) or (3), the manufacturing method comprising:

inserting a sub-housing having a cavity for insertion of a part connectable to the standing terminals into the opening of the housing so as to protect the standing terminals after erecting the standing terminal.

(5) The manufacturing method for the electric connection block according to any one of (1) to (4), wherein the standing terminals comprising fork terminals having pinching slits for pinching a blade-shaped terminal.

(6) The manufacturing method for the electric connection block according to any one of (1) to (5), and the bus bar in the press molding stage provided with bridge portions, the bridge portions holding the other portion than the main plate parts by connecting the other portion to the main plate parts before cut, and disconnecting electrically the other portion from the main plate parts after cut, the manufacturing method comprising:

cutting the bridge portions when bending the base ends of the standing terminals after insert molding of the housing.

According to the manufacturing method having the above (1) structure, the standing terminals are bent after the housing is insert molded integrally with the bus bar and, in a stage before execution of such bending, the bus bar is handled while the standing terminals are located on the same plane as the main plate part. This can prevent an external force from being unexpectedly applied to the standing terminals. Thus, useless deformation of the standing terminals can be avoided, thereby enabling securing necessary dimension precision. Also, since, after insert molding of the housing, the standing terminals can be protected by the housing, the standing terminals after erected can be prevented against deformation.

According to the manufacturing method having the above (2) structure, since, by inserting the bending tool into the opening formed in the housing, bending work of the base ends of the standing terminals can be facilitated.

According to the manufacturing method having the above (3) structure, since the protection wall is erected on the periphery of the opening of the housing, deformation of the standing terminals can be prevented effectively.

According to the manufacturing method having the above (4) structure, since the standing terminals can be protected by inserting the sub-housing into the opening of the housing, when connecting a part from outside, the standing terminals can be prevented against deformation.

According to the manufacturing method having the above (5) structure, the tuning fork terminals provided as the standing terminals can be prevented against unexpected deformation, thereby enabling securing the dimension precision of the tuning fork terminals.

According to the manufacturing method having the above (6) structure, the bridge portions are cut simultaneously with bending of the standing terminals, thereby enabling facilitation of the operation.

Effects of the Invention

According to the invention, useless deformation of the standing terminals during production can be prevented, thereby enabling securing necessary dimension precision.

The invention has been described heretofore briefly. Further, when a mode for enforcing the invention to be described below (which is called "an embodiment") is read through with reference to the accompanying drawings, the invention can be clarified further.

MODE FOR CARRYING OUT THE INVENTION

Description is given below of an embodiment of the invention with reference to the drawings.

FIGS. 1 to 7 are step explanatory views of a BFT manufacturing method according to the invention.

Figure 1:
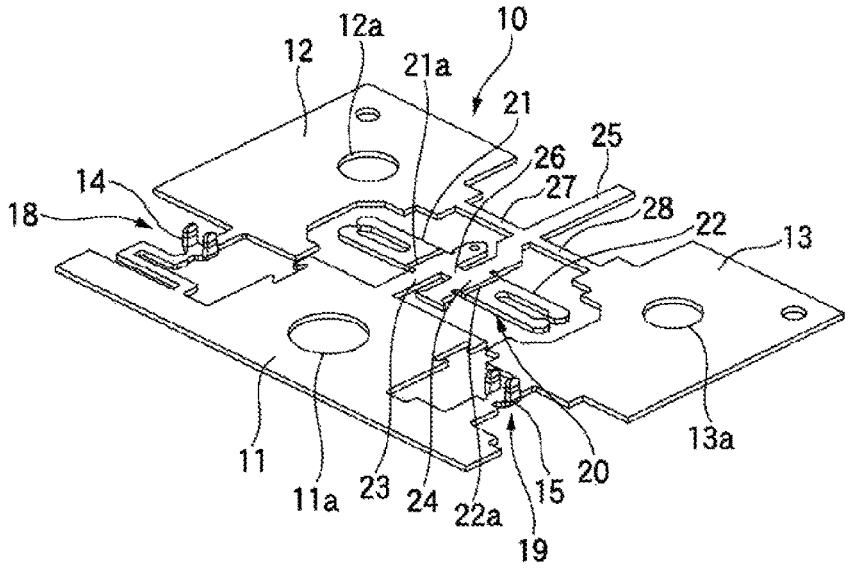
FIG. 1 is a perspective view of a BFT according to an embodiment of the invention, explaining the steps of manufacturing the same.
Figure 2:
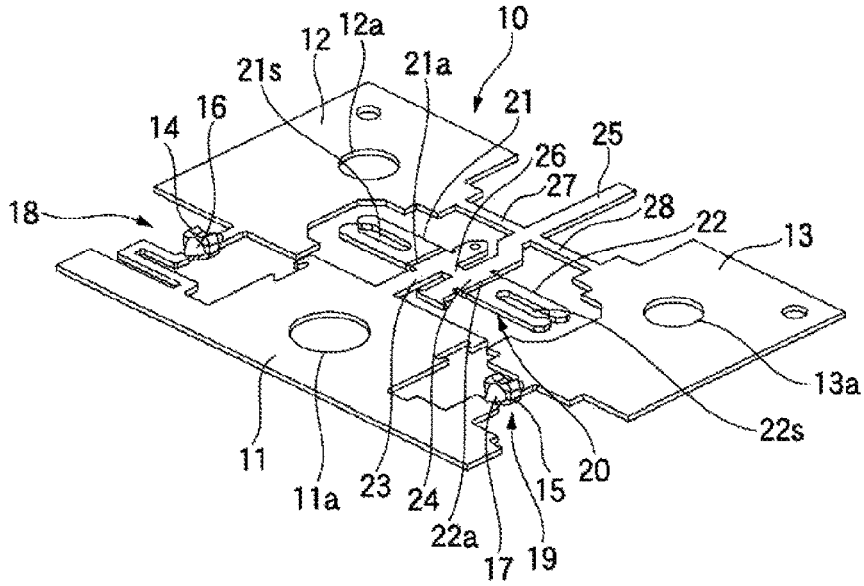
FIG. 2 is a perspective view, explaining a next step to be executed after FIG. 1.
Figure 3:
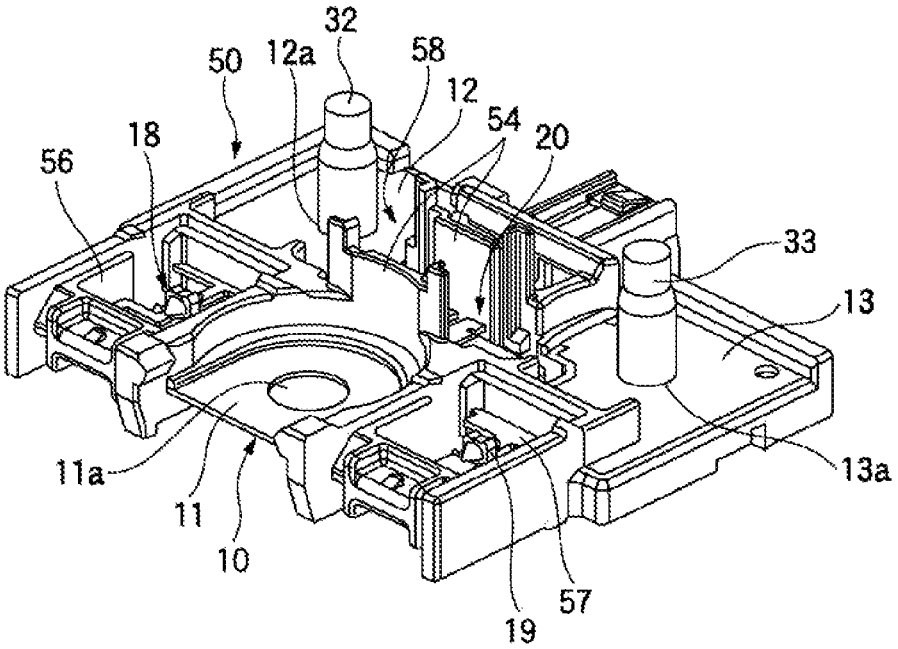
FIG. 3 is a perspective view, explaining a next step after FIG. 2.
Figure 4:
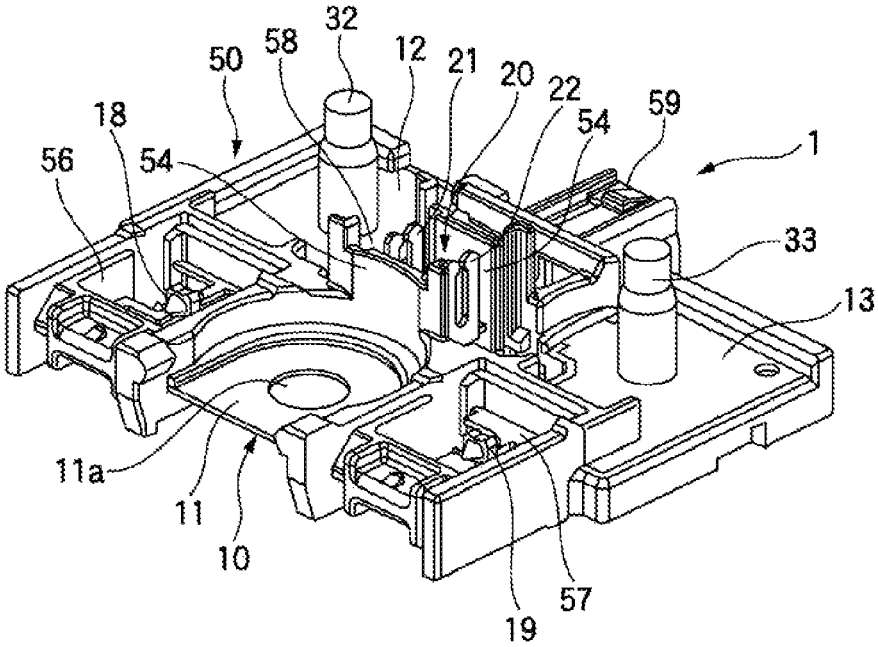
FIG. 4 is a perspective view, explaining a next step after FIG. 3.

BFT means a battery direct-attachment fuse terminal (which is also called a battery direct-attachment fuse unit) to be attached to the battery of a vehicle. The BFT of this embodiment includes, as shown in FIGS. 1 and 2, a bus bar 10 formed by press working a metal flat plate and, as shown in FIGS. 3 and 4, a resin-made housing 50 so insert molded as to cover other parts of the bus bar 10 than the exposed parts thereof.

When manufacturing a BFT 1 according to the method of the embodiment, firstly, a metal flat plate is press worked to form the bus bar 10. The bus bar 10, as shown in FIG. 1, includes an input side terminal part 11 connectable to the positive terminal of a battery and two output side terminal parts 12, 13 connectable by a load side wire. The input side terminal part 11 and output side terminal parts 12, 13 include circular holes 11*a*, 12*a* and 13*a* for insertion of a battery post, a stud bolt or the like. The terminal parts 11, 12 and 13 are respectively located on the same plane and have a substantially rectangular plate shape and constitute the flat plate shaped main plate part of the bus bar 10.

The bus bar 10 also includes welding parts 18, 19 respectively having chip caulking pieces 14, 15. The welding parts 18, 19 respectively connect the input side terminal part 11 to the two output side terminal parts 12, 13. The input side terminal 11 and two output side terminals 12, 13 are respectively arranged at the three apexes positions of a triangle and, in a space surrounded by the terminal parts 11, 12 and 13, there are arranged tuning fork terminals 21, 22 serving as standing terminals. The tuning fork terminals 21, 22 respectively have clipping slits 21*s*, 22*s* for clipping a blade-type terminal 65*a* of an external fuse 65 (see FIG. 7). Also, between the two output side terminals 12 and 13, there is arranged an external connection terminal 25 connectable by the connector terminal of an external part.

Here, the external connection terminal 25 is connected to the output side terminal parts 12, 13 by bridge portions 27, 28 to be cut later. The bridge portions 27, 28 are temporary joints which, before cut, connect the other part (external connection terminal 25) than the main plate part to the main plate part (output side terminal parts 12, 13) to thereby hold the other part (external connection terminal 25) and, after cut, electrically cut the other part (external connection terminal 25) from the main plate part (output side terminal parts 12, 13).

One tuning fork terminal 21 is connected to the input side terminal part 11 by a base portion 23 formed continuously with the base end 21*a* of the tuning fork terminal 21. The other tuning fork terminal 22 is connected to the external connection terminal 25 by a base portion 24 formed continuously with the base end 22*a* of the tuning fork terminal 22. Also, the base portions 23, 24 of the two tuning fork terminals 21, 22 are also connected together by a bridge portion 26 to be cut later. The bridge portion 26 is a temporary joint used to hold the two tuning fork terminals 21, 22 at specific positions relative to each other during the time from press working to housing 50 insert molding.

In the first pressing step, working is retained in a prior-to-bending state where the tuning fork terminals 21, 22 are located on the same plane as the main plate part (input and output side terminal parts 11 and 12, 13). That is, the tuning fork terminals 21, 22 are purposely kept without being bent. In this state, as shown in FIG. 2, the tin chips 16, 17 of low melting-point metal are caulked and welded to the chip caulking pieces 14, 15 of the welding parts 18, 19, thereby completing the welding parts 18, 19.

Figure 5:
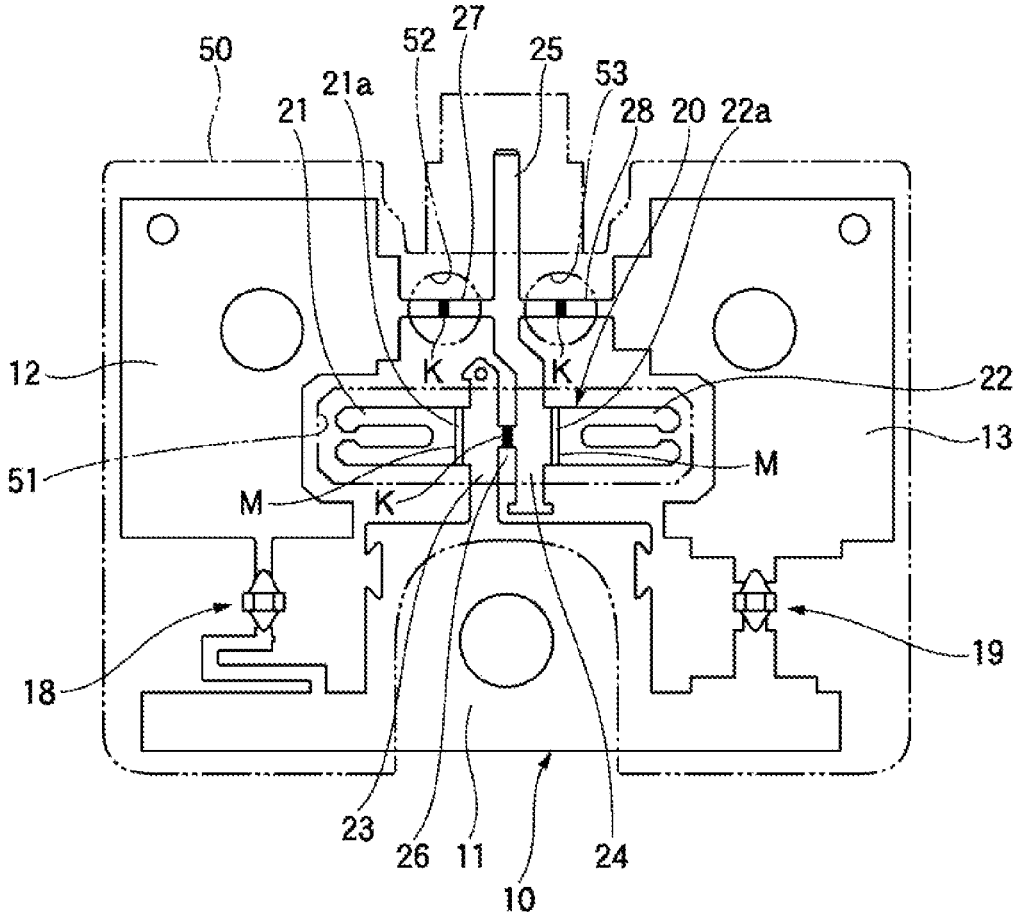
FIG. 5 is a plan view, showing a schematic structure in the step of FIG. 3.

Next, as shown in FIG. 2, the bus bar 10 kept in a substantially flat state (in the prior-to-bending state where the tuning fork terminals 21, 22 are located on the same plane as the main plate part) is set in a molding mold (not shown) and, as shown in FIG. 3, the resin-made housing 50 is insert molded. In the housing 50 insert molding, as shown in FIG. 5, the housing 50 is molded such that the tuning fork terminals 21, 22 before bent, the base ends 21*a*, 22*a* (especially, bending curves M) of the tuning fork terminals 21, 22 to be bent, and the cutting portions K of the bridge portions 26, 27, 28 face into openings 51, 52, 53 formed in the housing 50.

Also, as shown in FIG. 3, on the periphery of the opening 51 which the tuning fork terminals 21, 22 face, there is erected a protection wall 54 for protecting the tuning fork terminals 21, 22. Stud bolts 32, 33 are previously inserted into the circular holes 12*a*, 13*a* of the output side terminal parts 12, 13. In a stage where the molding step is ended, the input and output side terminal parts 11 and 12, 13 are exposed from the housing 50 and are ready to be connected to the battery terminal and load side wire. Further, the tuning fork terminals 21, 22 are exposed into an external part mounting portion 58 surrounded by the protection wall 54, the welding parts 18, 19 are exposed into fuse monitoring window portions 56, 57, and the external connection terminal 25 is exposed into a connector part 59.

Figure 6:
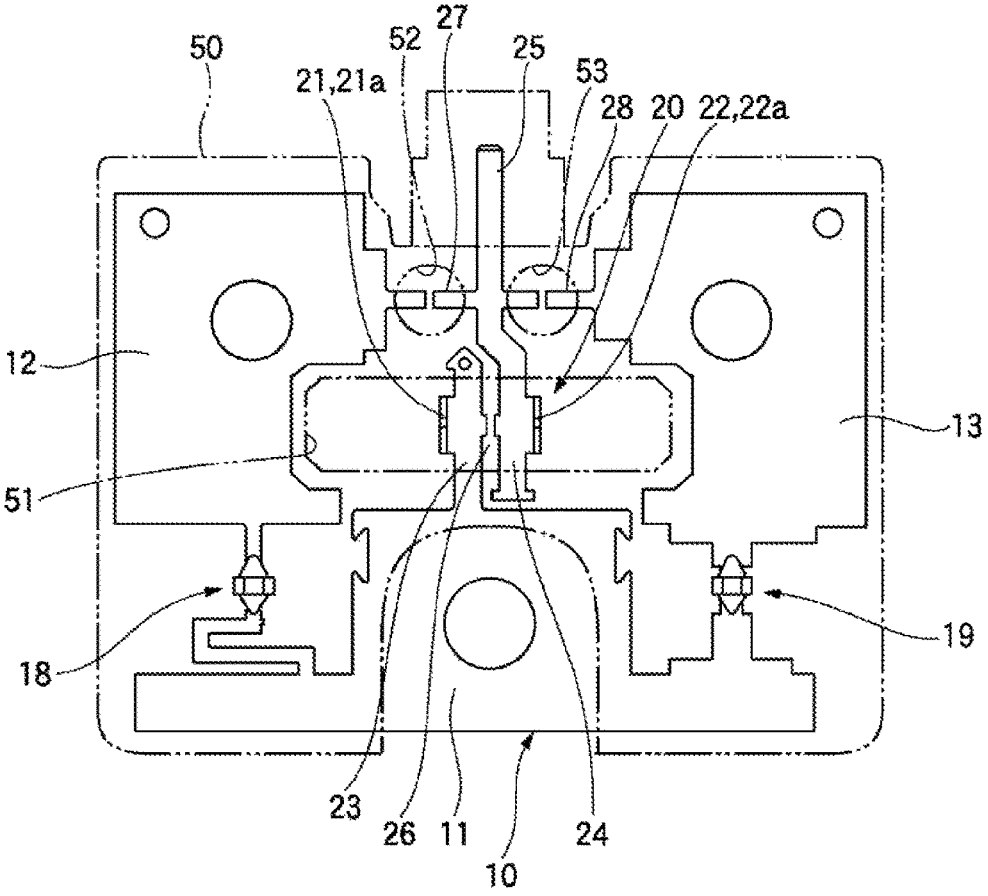
FIG. 6 is a plan view, showing a schematic structure in the step of FIG. 4.

Next, after molding of the housing 50, an assembly of the integrated housing 50 and bus bar 10 is set in a press machine and, by inserting a bending tool into the opening 51 of the housing 50, the base ends 21*a*, 22*a* of the tuning fork terminals 21, 22 are bent 90°. Thus, as shown in FIGS. 4 and 6, the tuning fork terminals 21, 22 are erected perpendicularly to the input and output side terminal parts 11, 12, 13 serving as the main plate part. In this step, simultaneously, the bridge portions 26, 27, 28 are cut in the cutting portions K.

Figure 7:
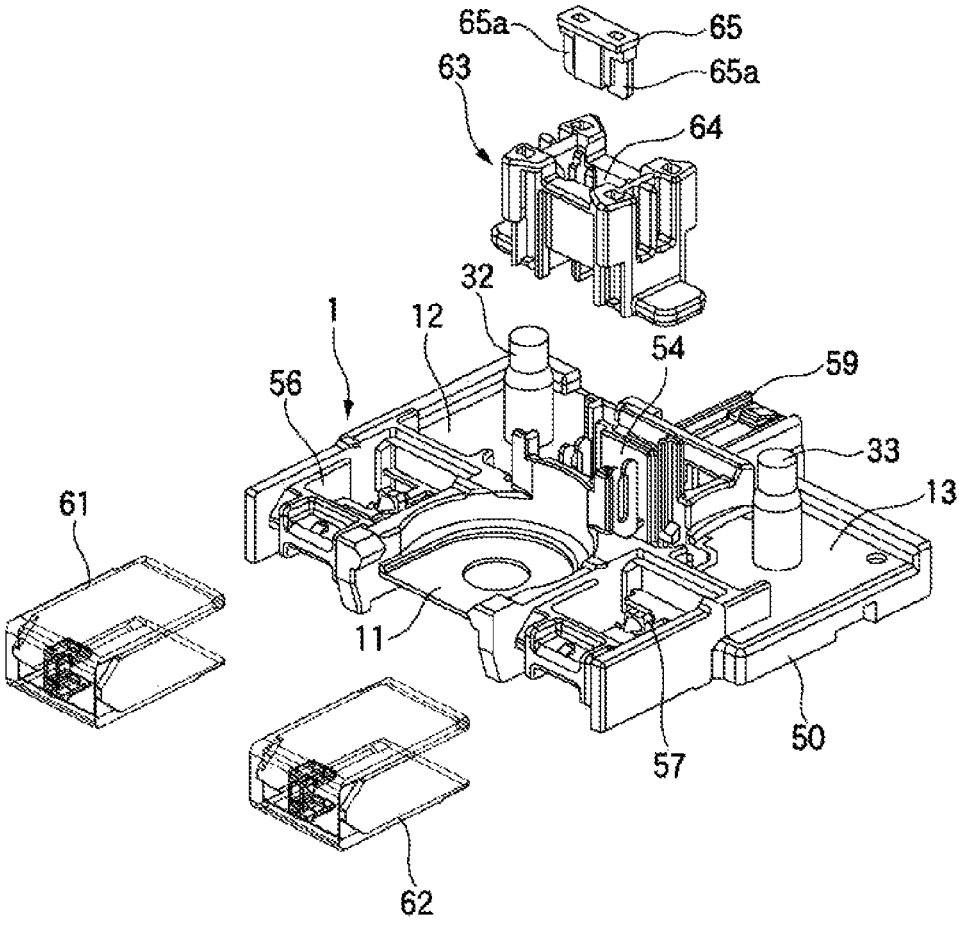
FIG. 7 is a perspective view, explaining a next step after FIG. 4.
Figure 8:
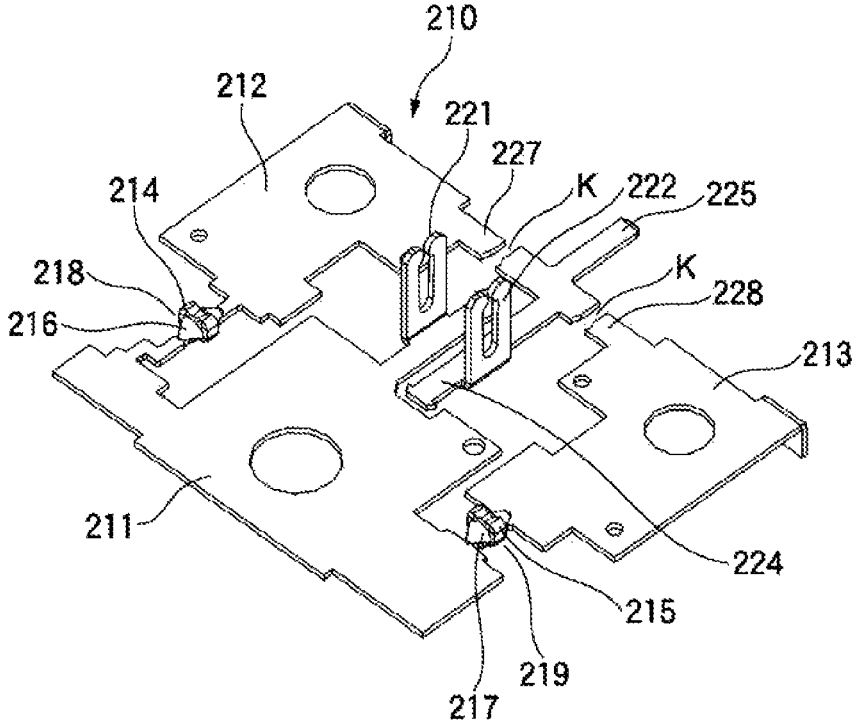
FIG. 8 is a perspective view of a bus bar of a conventional BFT.
Figure 9:
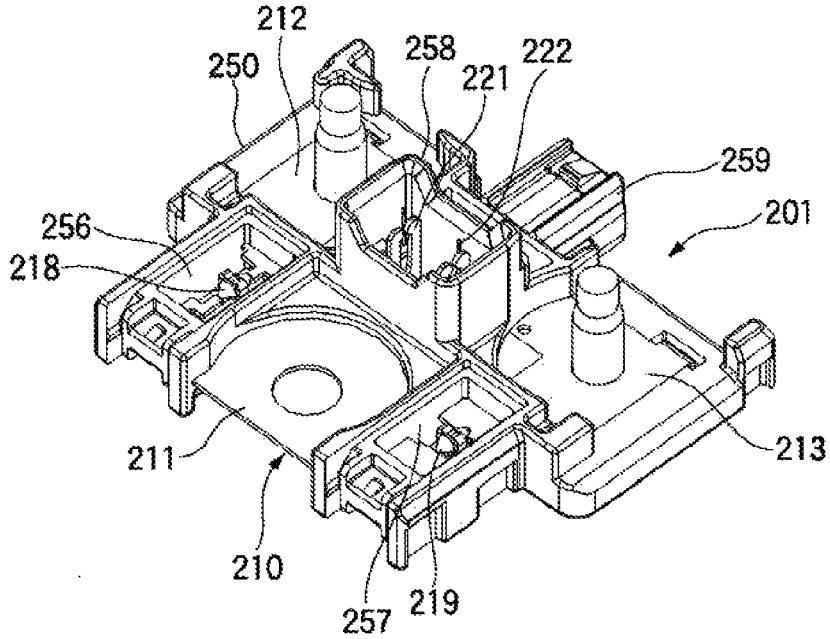
FIG. 9 is a perspective view of the conventional BFT.

After the above step, as shown in FIG. 7, into the opening 51 of the housing 50, there is inserted a sub-housing 63 having a cavity 64 for insertion of the external fuse 65 connectable to the tuning fork terminals 21, 22, thereby protecting the terminals 21, 22. Further, a transparent cover 61 is mounted on the fuse monitoring window portions 56, 57, thereby completing the BFT 1.

As described above, according to the BFT manufacturing method of this embodiment, the tuning fork terminals 21, 22 serving as standing terminals are bent after the housing 50 is insert molded integrally with the bus bar 10 and, in the stage before this, the bus bar 10 is handled in a state where the tuning fork terminals 21, 22 are located on the same plane as the main plate part (input and output side terminal parts 11, 12, 13). This can prevent an external force from being applied unexpectedly to the tuning fork terminals 21, 22. As a result, useless deformation of the tuning fork terminals 21, can be avoided, thereby enabling ensuring necessary dimension precision.

For example, in the press molding stage, since the tuning fork terminals 21, 22 are not erected, they can be prevented against deformation when taking them out from the press machine or when moving them between the pressing steps. In the tin caulking and welding step as well, since the tuning fork terminals 21, 22 are not erected, they can be prevented against deformation. Also, when the housing 50 is set in the molding mold, the mold is closed, the mold is opened, and the housing 50 is taken out from the mold, since the tuning fork terminals 21, 22 are not erected, they can be prevented against deformation.

Also, after insert molding of the housing 50, since the tuning fork terminals 21, 22 can be protected by the protection wall 54 formed integrally with the housing 50, the tuning fork terminals 21, 22 after erected can be prevented against deformation. Also, since the tuning fork terminals 21, 22 can be protected by inserting the sub-housing 63 into the opening 51 of the housing 50, when connecting the external fuse 65 from outside, the tuning fork terminals 21, 22 can be prevented against deformation.

Also, since, by inserting the bending tool into the opening 51 of the housing 50, the bending work of the base ends 21*a*, 22*a* of the tuning fork terminals 21, 22 can be executed, bending work after insert molding can be facilitated.

Since cutting of the bridge portions 26, 27, 28 is executed simultaneously with bending of the tuning fork terminals 21, 22, operation can be facilitated.

Here, the invention is not limited to the above embodiment but changes, improvements and the like are also possible properly. Also, the materials, shapes, dimensions, number, arrangement positions and the like of the respective composing parts of the above embodiment are arbitrary and are not limitative so long as they can attain the invention.

For example, although, in the above embodiment, the standing terminals are constituted of the tuning fork terminals 21, 22, other terminals may also be used so long as they stand up from the main plate part.

Also, in the above embodiment, the base portions 23, 24 of the two tuning fork terminals 21, 22 are connected together by the bridge portion 26. However, without forming the bridge portion 26 from the first, the two base portions 23, 24 may previously be separated from each other.

In the description of the above embodiment, although BFT is used as an electric connection block, the invention can apply widely to other electric connection block constituted of a bus bar having a standing terminal erected from a main plate part and a housing.

Here, the characteristics of the above embodiment of an electric connection block according to the invention are described below briefly in the items [1] to [6].

The manufacturing method for the electric connection block, the electric connection block (BFT1) including a bus bar (10) formed from a press-formed product of a metal plate member and a resin-made housing (50) insert molded integrally with the bus bar, and the bus bar including the flat plate-shaped main plate parts (input side terminal part 11, and output side terminal parts 12, 13) and standing terminals (tuning fork terminals 21, 22) erected by bending base ends connected to a portion of the main plate parts relative to the main plate parts, the manufacturing method comprising:

insert molding the housing integrally with the bus bar in a before-bending state where the standing terminals are located on the same plane as the main plate parts; and bending the base ends of the standing terminals to thereby erect the standing terminals relative to the main plate parts after insert molding of the housing.

The manufacturing method for the electric connection block according to [1], the manufacturing method comprising:

molding the housing such that the before-bent standing terminals face into openings (51, 52, 53) formed in the housing when insert molding of the housing; and inserting the bending tool into the opening and bending the base ends of the standing terminals to thereby erect the standing terminals after molding of the housing.

[3] The manufacturing method for the electric connection block according to [2], the manufacturing method comprising:

erecting protection walls (54) for protecting the standing terminals on periphery of the opening of the housing.

[4] The manufacturing method for the electric connection block according to [2] or [3], the manufacturing method comprising:

inserting a sub-housing (63) having a cavity (64) for insertion of apart connectable to the standing terminals into the opening of the housing so as to protect the standing terminals after erecting the standing terminal.

[5] The manufacturing method for the electric connection block according to any one of [1] to [4], wherein the standing terminals comprising fork terminals having pinching slits (21*s*, 22*s*) for pinching a blade-shaped terminal.

[6] The manufacturing method for the electric connection block according to any one of [1] to [5], and the bus bar in the press molding stage provided with bridge portions (26, 27, 28), the bridge portions holding the other portion than the main plate parts by connecting the other portion to the main plate parts before cut, and disconnecting electrically the other portion from the main plate parts after cut, the manufacturing method comprising:

cutting the bridge portions when bending the base ends of the standing terminals after insert molding of the housing.

Although the invention has been described heretofore specifically and with reference to the specific embodiment, it is obvious to a person skilled in the art that various changes and modifications are possible without departing from the spirit and scope of the invention.

The application is based on Japanese Patent Application (No. 2013-101599) filed on May 13, 2013 and thus the contents thereof are incorporated herein for reference.

INDUSTRIAL APPLICABILITY

According to the invention, useless deformation of the standing terminals during production can be avoided, thereby enabling securing necessary dimension precision. The invention having this effect can apply effectively to a manufacturing method for, for example, a battery direct-attachment fuse terminal to be mounted on the battery of a vehicle.

DESCRIPTION OF REFERENCE NUMERALS AND SIGNS

1: BFT (electric connection block)
10: bus bar
11: input side terminal part (main plate part)
12, 13: output side terminal part (main plate part)
21, 22: tuning fork terminal (standing terminal)
21*a*, 22*a*: base end
21*s*, 22*s*: pinching slit
26, 27, 28: bridge portion
50: housing
51: opening
52, 53: opening
54: protection wall
63: sub-housing
64: cavity for insertion
65: blade-type fuse (external part)

What is claimed is:

1. A manufacturing method of an electric connection block, the electric connection block including a bus bar formed from a press-formed product of a metal plate member and a resin-made housing insert molded integrally with the bus bar, and the bus bar including a flat plate-shaped main plate part and a standing terminal erected by bending a base end connected to a portion of the main plate part relative to the main plate part, the manufacturing method comprising:

insert molding the housing integrally with the bus bar in a before-bending state where the standing terminal is located on the same plane as the main plate part such that the before-bent standing terminal faces into an opening formed in the housing; and bending the base end of the standing terminal to thereby erect the standing terminal relative to the main plate part from the opening after the insert molding of the housing.

2. A manufacturing method of an electric connection block, the electric connection block including a bus bar formed from a press-formed product of a metal plate member and a resin-made housing insert molded integrally with the bus bar, and the bus bar including a flat plate-shaped main plate part and a standing terminal erected by bending a base end connected to a portion of the main plate part relative to the main plate part, the manufacturing method comprising:

insert molding the housing integrally with the bus bar in a before-bending state where the standing terminal is located on the same plane as the main plate part;

bending the base end of the standing terminal to thereby erect the standing terminal relative to the main plate part after the insert molding of the housing;

molding the housing such that the before-bent standing terminal faces into an opening formed in the housing when insert molding of the housing; and inserting a bending tool into the opening and bending the base end of the standing terminal to thereby erect the standing terminal after the insert molding of the housing.

3. The manufacturing method of the electric connection block according to claim 2, the manufacturing method further comprising:

erecting a protection wall for protecting the standing terminal on a periphery of the opening of the housing.

4. The manufacturing method of the electric connection block according to claim 2, the manufacturing method further comprising:

inserting a sub-housing having a cavity for insertion of a part connectable to the standing terminal into the opening of the housing so as to protect the standing terminal after the erecting of the standing terminal.

5. The manufacturing method of the electric connection block according to claim 3, the manufacturing method further comprising:

inserting a sub-housing having a cavity for insertion of a part connectable to the standing terminals into the opening of the housing so as to protect the standing terminals after the erecting of the standing terminal.

6. The manufacturing method of the electric connection block according to claim 1, wherein the standing terminal comprises a fork terminal having a pinching slit for pinching a blade-shaped terminal.

7. The manufacturing method of the electric connection block according to claim 1, the manufacturing method further comprising:

providing a bridge portion on the bus bar in the press molding stage, the bridge portion holding a portion of the bus bar other than the main plate part by connecting the portion of the bus bar other than the main plate part to the main plate part before cut, and electrically disconnecting the portion of the bus bar other than the main plate part from the main plate part after cut; and cutting the bridge portion when bending the base end of the standing terminal after the insert molding of the housing.

8. The manufacturing method of the electric connection block according to claim 2, the manufacturing method further comprising:

providing a bridge portion on the bus bar in the press molding stage, the bridge portion holding a portion of the bus bar other than the main plate part by connecting the portion of the bus bar other than the main plate part to the main plate part before cut, and electrically disconnecting the portion of the bus bar other than the main plate part from the main plate part after cut; and cutting the bridge portion when bending the base end of the standing terminal after the insert molding of the housing.

* * * * *